United States Patent [19]

Helm et al.

[11] 3,977,530

[45] Aug. 31, 1976

[54] CRANE WITH GANTRY BACKHITCH AND BOOM HOIST ASSEMBLY REMOVABLE AS A UNIT

[75] Inventors: Percy R. Helm; James G. Morrow, Sr.; David J. Pech, all of Manitowoc, Wis.

[73] Assignee: The Manitowoc Company, Inc., Manitowoc, Wis.

[22] Filed: June 13, 1974

[21] Appl. No.: 478,978

[52] U.S. Cl. ..... 212/46 R; 212/144

[51] Int. Cl.[2] ..... B66C 1/12

[58] Field of Search ..... 212/46 R, 8 R, 58 R, 212/46 A, 59 R, 61, 64, 65, 144

[56] References Cited

UNITED STATES PATENTS

| | | | |
|---|---|---|---|
| 3,045,837 | 7/1962 | Liebherr et al. | 212/46 R |
| 3,053,398 | 9/1962 | Liebherr et al. | 212/64 X |
| 3,187,906 | 6/1965 | Bushong et al. | 212/59 R |
| 3,228,535 | 1/1966 | Butcher | 212/58 R |
| 3,335,877 | 8/1967 | Pezzini | 212/144 |
| 3,399,785 | 9/1968 | Mork | 212/46 R |
| 3,664,516 | 5/1972 | Goudy | 212/144 X |

*Primary Examiner*—Albert J. Makay
*Assistant Examiner*—R. B. Johnson
*Attorney, Agent, or Firm*—Leydig, Voit, Osann, Mayer & Holt, Ltd.

[57] ABSTRACT

A mobile crane with rotating bed, mast, gantry and gantry backhitch is arranged for disassembly and ease of transport without unreeving the boom hoist rigging by collapsing the backhitch, folding the gantry back onto the backhitch, pinning together the backhitch, gantry and boom hoist assembly — which includes the boom hoist drum and motor, and releasing the gantry, backhitch and boom hoist assembly from the rotating bed. A bracket is fixed to the gantry to provide an anchoring point for the equalizer assembly normally secured to the boom.

3 Claims, 5 Drawing Figures

36
35
34
33
47
15
41
21
44
14
33
23
10
42
54
53
24
30
13
12
11

10
13
12
21
22
23
24
30
31
32
33
34
41
42
43
44
45
46
47
50
51
52
53
3

CRANE WITH GANTRY BACKHITCH AND BOOM HOIST ASSEMBLY REMOVABLE AS A UNIT

This invention relates generally to load lifting cranes and more particularly concerns a boom hoist and gantry assembly for such cranes.

In order to handle the high capacities demanded of modern cranes, cranes have greatly increased in size to the point where even fully mobile cranes must be broken down into major components for shipment to and from job sites. With long booms and heavy loads, the rigging for high capacity cranes becomes more complex with the wire rope normally used being run in many-part assemblies. Obviously, many-part rigging run between banks of equalizer pulleys presents a difficult and time consuming assembly and disassembly job. Therefore, while the need for convenient disassembly of large, high capacity cranes increases, the increased complexity of their design makes this more difficult.

Accordingly, it is the primary aim of the invention to provide a crane with a major subassembly including the gantry and boom hoist which can be detached and shipped as a unit without disassemblying or unreeving the boom rigging. A collateral object is to greatly speed and facilitate the erection of a crane by obviating the need for laboriously reeving the boom rigging.

It is also an object of the invention to provide a subassembly of the above character that, in transport configuration, is quite compact but which does not sacrifice strength and load capacity when in use.

A further object is to provide a subassembly as characterized above which can be quickly and easily converted between transport position and erect working position.

Other objects and advantages of the invention will become apparent upon reading the following detailed description and upon reference to the drawings, in which.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Figure 1:
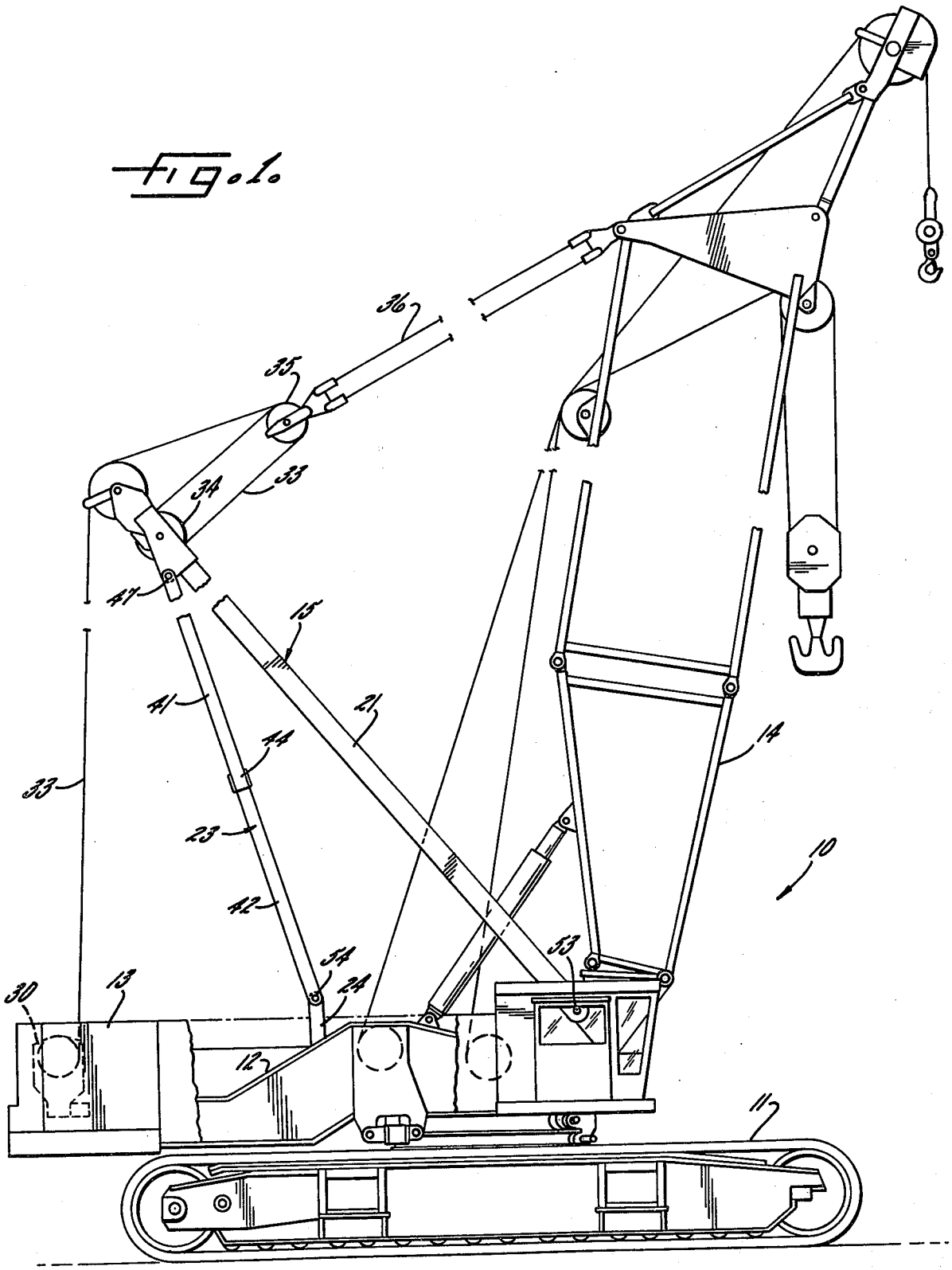
FIG. 1 is a fragmentary side elevation, somewhat schematic, of a crane embodying the invention.
Figures 2, 3:
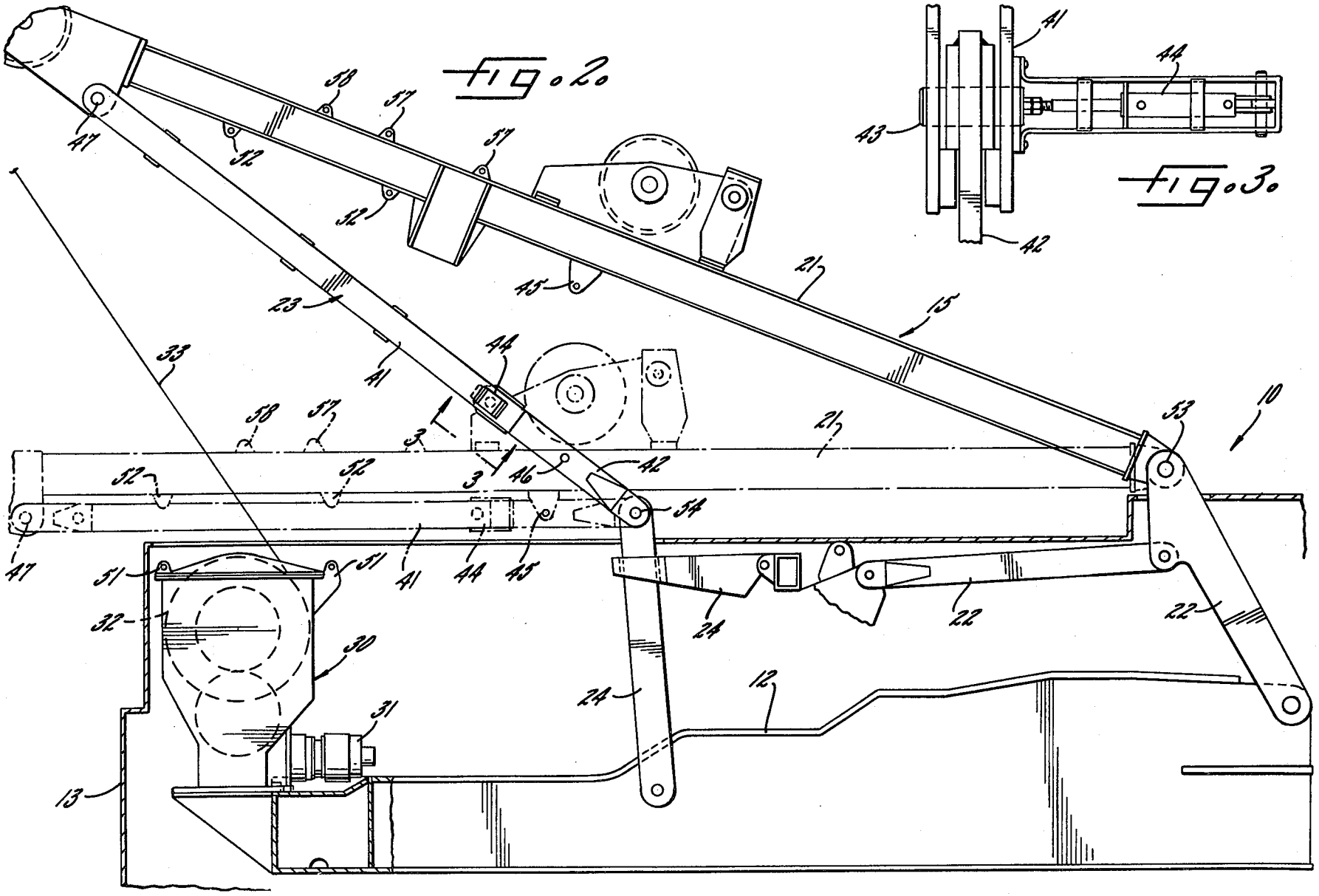
FIG. 2 is an enlarged fragmentary side elevation and section of a portion of the crane otherwise appearing in FIG. 1 with some parts in alternate positions.
FIG. 3 is an enlarged fragmentary elevation taken along the line 3—3 in FIG. 2.

Turning now to the drawings, there is shown in FIG. 1 a crane 10 embodying the invention and including lower machinery crawlers 11, a rotating bed 12 mounted on the crawlers 11 and carrying an upper machinery cab 13 and a boom 14 pivoted for vertical movement, and a subassembly 15 for vertically positioning the boom 14. The subassembly 15 includes a gantry 21, which is an open generally rectangular frame (see FIG. 5) secured to the bed 12 through legs 22 and pivoted for movement between an upright working position (see FIG. 1) and a transfer position overlying the cab 13 (see FIG. 2), and a backhitch 23 pivotally secured between the bed 12, through legs 24, and the gantry 21 to resist movement of the gantry toward the boom.

As is conventional, up and down boom movement is controlled by a boom hoist assembly 30 including a motor 31 geared to a drum 32 and rigging including a line 33 wound on the drum 32 and running between a pair of equalizer assemblies 34 and 35. One such assembly 34 is mounted on the end of the gantry 21 and the other assembly 35 is secured by pendants 36 to the top of the boom 14.

In accordance with the invention, the backhitch 23 is selectively collapsible so that the gantry 21 can be pivoted to its transport position with the backhitch lying beneath the gantry, means are provided for locking the gantry, backhitch and hoist assembly 30 together, and the assembly 30, backhitch 23 and gantry 21 are selectively releasable from the bed 12 for handling as a unit. In the preferred embodiment, the backhitch 23 includes upper and lower frames 41 and 42, respectively, with the lower frame 42 being slidable in the upper frame 41 and, in working position, being locked against such sliding movement by pins 43 (see FIG. 3) which can be removed by actuator assemblies 44. To lock the gantry 21 and the backhitch 23 together, lugs 45 on the gantry 21 register with holes 46 in the lower frame 42 of the backhitch, so that, in collapsed transport position, pins can be inserted. The upper frame 41 of the backhitch remains connected to the gantry by its normal pivot pins 47.

For locking the hoist assembly 30 to the gantry-backhitch assembly, a simple link frame 50 is attached between lugs 51 on the assembly and lugs 52 on the gantry. The gantry 21 and the backhitch 23 are released from the bed 12 by removing pivot pins 53 and 54, and the boom hoist assembly 30 is released from the bed 12 by removing suitable pins and hydraulic quick disconnect pressure lines (not shown) that provide driving power to the motor 31 and the normal brakes and clutches of the assembly.

As another step in making the subassembly 15 ready for separate handling, the equalizer 35 is disconnected from the pendants 36 and anchored to a bracket 56 fixed on the top of the gantry by being pinned to lugs 57. Another set of lugs 58 are fixed to the gantry 21 at the approximate center of gravity of the subassembly 15 to provide a lifting hitch point.

As those skilled in the art will appreciate, the subassembly 15 including, as it does, the boom hoist assembly as well as the gantry and backhitch results in a substantial saving of the time and effort normally required to unreeve the boom hoist rigging when a large, high capacity crane is separated into major components for shipping. Erection of the crane at a job site is likewise greatly simplified since the subassembly 15 can be simply lifted and lowered into place over the crane bed 12 and pinned into position. Subsequent release of just a few pins allows the assembly 15 to be connected in full operating position.

Figures 4, 5:
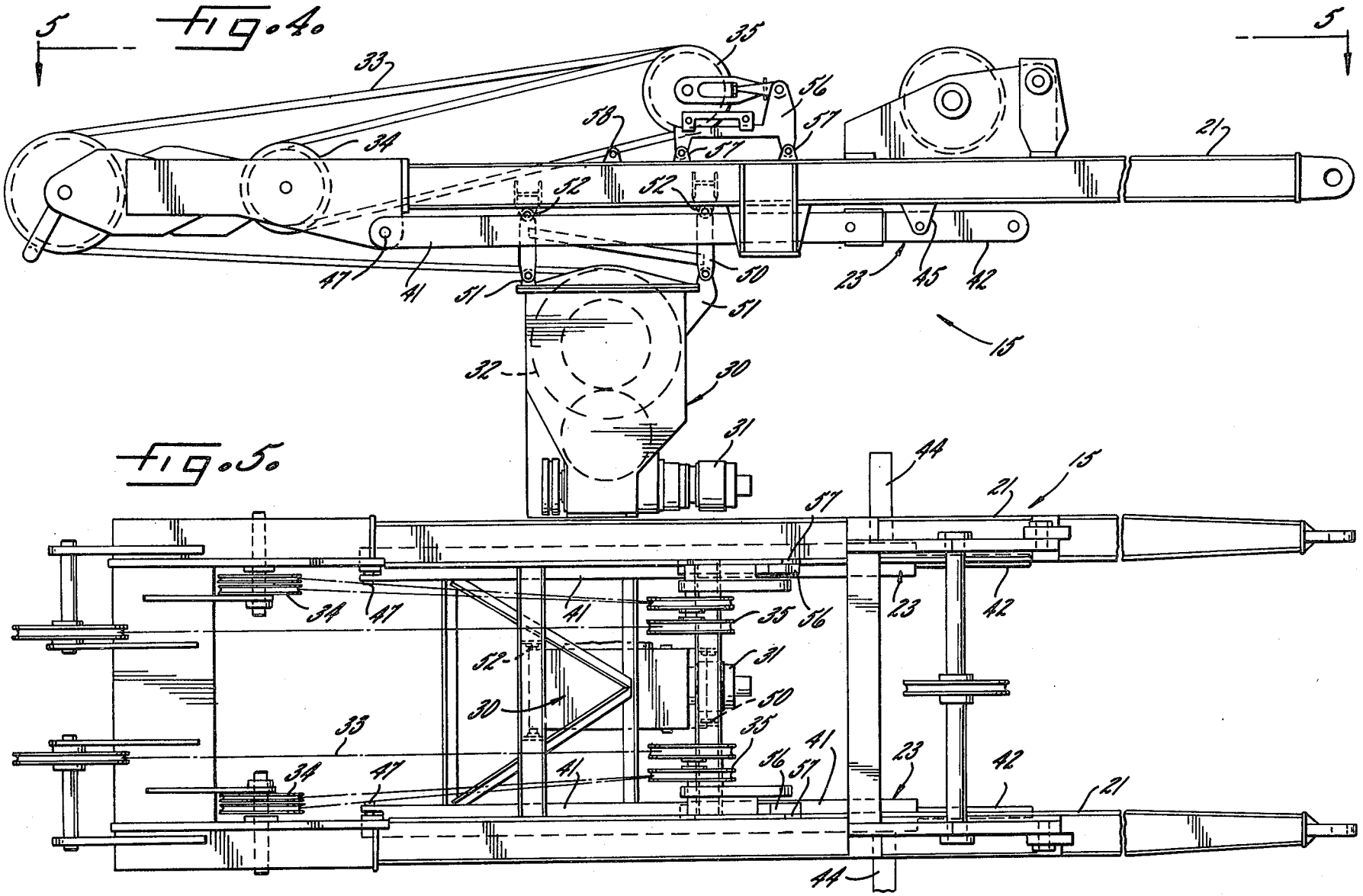
FIG. 4 is an enlarged side elevation of portions of the crane otherwise appearing in FIG. 2 mounted for removal and separate handling.
FIG. 5 is a plan taken along the line 5—5 in FIG. 4.

It will also be readily seen, particularly in FIGS. 4 and 5, that the subassembly 15 is quite compact when folded into its transport position and those skilled in the art will further appreciate that the gantry 21 and backhitch 23 are essentially conventional, box-like, high strength units so that incorporating the invention has not sacrificed strength or load handling capacity when the crane is set up and in use.

We claim as our invention:

1. In a crane having a rotating bed carrying an upper machinery cab and a boom pivoted for vertical movement, a subassembly for vertically positioning said boom comprising, in combination, a gantry secured to said bed and pivoted for movement between an upright working position and a transport position overlying said cab, a backhitch pivotally secured to said bed and said gantry to resist movement of the gantry toward said boom, said backhitch being selectively collapsible so that said gantry can be pivoted to said transport position with the backhitch lying beneath the gantry, a boom hoist assembly removably mounted on said bed within the cab and including a motor and a drum, said motor being coupled to said drum, boom rigging including a pair of equalizer assemblies secured respectively to said gantry and said boom and a line wound on said drum and running between said equalizer assemblies, means intermediate the ends of the gantry for locking the gantry and backhitch together when the former is in said transport position, and means including a link for locking said hoist assembly to the locked gantry and backhitch, said gantry, said backhitch and said boom hoist assembly being selectively releasable from said bed so that the interlocked gantry, backhitch and hoist assembly can be separated from the bed and cab and handled as a unit without unreeving the boom rigging.

2. The combination of claim 1 including a bracket secured to said gantry to define an anchoring point for that equalizer assembly which is secured to the boom when the crane is rigged for operation.

3. The combination of claim 1 in which said backhitch is formed of relatively telescoping sections so that the backhitch can be collapsed by telescoping said sections together.

* * * * *